US006215055B1

(12) United States Patent
Saravis

(10) Patent No.: US 6,215,055 B1
(45) Date of Patent: Apr. 10, 2001

(54) FOOT PEDAL BOARDS FOR MUSICAL INSTRUMENTS

(76) Inventor: Darren Saravis, 2114 Fidler Ave., Long Beach, CA (US) 90815

( * ) Notice: Subject to any disclaimer, the term of this patent is extended or adjusted under 35 U.S.C. 154(b) by 0 days.

(21) Appl. No.: 09/472,164

(22) Filed: Dec. 27, 1999

Related U.S. Application Data

(63) Continuation of application No. 08/906,700, filed on Aug. 6, 1997.

(51) Int. Cl.[7] ..... G10D 13/02

(52) U.S. Cl. ..... 84/422.1; 84/746

(58) Field of Search ..... 84/422.1, 312 P, 84/444, 225, 353, 426, 746, 229; 206/314

(56) References Cited

U.S. PATENT DOCUMENTS 4,445,415 * 5/1984 Izquierdo ..... 84/177
5,105,711 * 4/1992 Barnard ..... 84/744

* cited by examiner

*Primary Examiner*—Robert E. Nappi
*Assistant Examiner*—Shih-yung Hsieh
(74) *Attorney, Agent, or Firm*—Robert J. Schaap

(57) ABSTRACT

A pedal board for releasably retaining a plurality of foot pedal operated sound effect generators used in conjunction with musical instruments, such as guitars. The pedal board comprises an upper plate having a surface constructed to releasably hold a plurality of foot pedal operated sound effect generators. The pedal board is provided with an internal wiring harness and external jacks for connection of the sound effect generators in a desired array and which enable connection to the musical instrument as well as to an auxiliary sound generating component used with the musical instrument.

14 Claims, 5 Drawing Sheets

FOOT PEDAL BOARDS FOR MUSICAL INSTRUMENTS

This is a Continuation of application Ser. No. 08/906,700 filed Aug. 6, 1997.

BACKGROUND OF THE INVENTION

1. Field of the Invention

This invention relates in general to certain new and useful improvements in foot pedal sound effect generator mounting boards and more particularly to a pedal board of the type stated which allows for connection of a plurality of foot pedal operated sound effect generators in a desired array with respect to a musical instrument to thereby alter the sound created by the musical instrument.

2. Brief Description of the Related Art

In recent years, the use of sound effects generated in conjunction with music from a musical instrument has become quite popular. There are a variety of foot pedal operated sound effect generators which are operated by the players of musical instruments in conjunction with the playing of the instruments to generate a desired sound effect along with the music. Typical sound effects which can be generated include, for example, distortion, wah-wah sounds, so-called "screaming" effects and the like.

These sound effect generators are typically referred to as foot pedals or typically "pedals". Generally, the pedals are used in conjunction with the instrument and an amplifier such that the musical instrument is connected to an amplifier for amplifying the sounds generated by the instrument and for playback on a speaker. The sound effect generators are connected to the amplifier so that the sound effects are mixed with the music generated by the musical instrument. In other cases, the sound effects are mixed with the music and introduced into other forms of auxiliary sound generating components, such as a tape recorder or a sound track, which may already have other prerecorded music thereon. These other auxiliary sound generating components may either amplify or otherwise capture sound, such as another sound effect processing unit.

A player of a musical instrument, such as a guitar, for example, may desire to obtain many different types of sound effects and therefore would be required to employ a plurality of foot pedal operated sound effect generators in conjunction with playing of the musical instrument. When the sound effect generators are employed, the musician typically places these foot pedals or generators on the floor of the facility in which the musician is playing. After the musician may engage one or more of the foot pedals on one or more occasions, the foot pedal tends to move and thus, are not in a position where the musician would expect the-foot pedals to be when next required for use. This is particularly a problem when a number of foot pedals are used in combination. Thus, the logistics of maintaining each of the foot pedals in a proper position so that the musician knows the location of those foot pedals by feel is quite complicated.

In addition to the foregoing, each of these foot pedals must be connected by a plurality of cables, either to one another or to the amplifier and to the guitar or other instrument. The plurality of cables interconnecting the various sound effect generators and the amplifier or other auxiliary sound generating component and musical instrument and the one or more speakers tend to become entangled with one another and often times will interfere with the ability of the musician to use his or her feet to engage the foot pedal operated sound effect generators.

There has been at least one proposed stand for foot pedal controls used in conjunction with a musical instrument, such as a keyboard, as for example, that device taught in U.S. Pat. No. 4,445,415, dated May 1, 1984 to Izquierdo. This particular device proposes a case or box with a removable top which can be raised in the form of a stand to hold the keyboard and with the foot pedals operationally located beneath the keyboard.

While the device proposed in the Izquierdo patent does provide for the locating of a plurality of foot pedals, it is specifically limited to use with an instrument which is disposed on the keyboard stand and foot pedals located therebeneath. Moreover, the Izquierdo patent does not provide for any means to fixedly, but nevertheless removably, mount the foot pedal sound effect generators in a specific position. Finally, the device in the Izquierdo patent is designed to be constructed in the form of a stand when in use, which is not only time consuming but requires numerous movable parts.

There has also been a pedal board offered by a company known as the Roland Corporation of Los Angeles, Calif. which includes a base, such as a pedal board, along with a carrying case therefore. Moreover, the Roland device is also designed to hold foot pedals. However, in the case of the Roland device, the board is provided with a plurality of recesses or pockets molded into a plastic base and which are each suitably sized to receive a foot pedal. However, the base in the Roland device is not universally adaptable and is only designed to receive those specific foot pedals offered by Roland and used in conjunction with musical instruments offered by the Roland Corporation and which are specifically sized for use on the Roland pedal board.

The commercially available foot pedals which provide differing types of sound effects are frequently made by differing organizations and will often come in different sizes and shapes. Hence, the pocket arrangement of the type in the Roland device is not suitable to retain these other commercially available foot pedals and is therefore is limited only to use with the foot pedals offered by the Roland Corporation.

There has also been a pedal board arrangement offered by Fxperts Pedal Boards of Raleigh, N.C. However, although this pedal board arrangement does consist of a base board, it has no means for electrically connecting the pedal boards and no means to retain the pedals in exact fixed positions. In addition, it has no means for providing electrical power to the various pedals. In effect, this device primarily serves only as a carrying case.

OBJECTS OF THE INVENTION

It is therefore, a primary object of the present invention to provide a foot pedal operated sound effect generator support board for holding a plurality of foot pedals in a desired array and for enabling connection of the foot pedals to a musical instrument through the board itself.

It is another object of the present invention to provide a foot pedal operated sound effect generating retaining board which will allow for mounting of the foot pedals in a desired arrangement in order to enable the musician to know by feel where each of the foot pedals are located and for easy access thereto.

It is a further object of the present invention to provide a foot pedal operated sound effect generating retaining board of the type stated which will allow for organizing and carrying of the foot pedals with a case lid releasably connected thereto and which contains sufficient power supply and signal loops.

It is an additional object of the present invention to provide a so-called "pedal board" of the type stated which can be constructed at a relatively low cost and which is easily usable and therefore widely available.

With the above and other objects in view, my invention resides in the novel features of form, construction, arrangement and combination of parts and components presently described and pointed out in the claims.

SUMMARY OF THE INVENTION

A pedal board for releasably retaining a plurality of foot operated sound effect generators which are used in conjunction with a musical instrument, such as a guitar or the like.

The term "pedal board" is the term applied to that device of the present invention having a flat surface for receiving a plurality of the foot pedal operated sound effect generators. These sound effect generators are typically connected to the guitar or other instrument and frequently to an auxiliary sound generating component, such as an amplifier for amplifying the sound otherwise generated by the instrument itself. The sound effect generators are operated by the feet of the musician and are typically referred to as "foot pedals" or otherwise, as "pedals".

The pedal board of the invention comprises a plate having a relatively flat upper surface. Means is associated with the upper surface of this plate to releasably hold a plurality of foot pedal operated sound effect generators such that the generators may be mounted on the upper surface of the plate in desired locations. In this way, the musician can easily and immediately locate each of the foot pedal operated sound effect generators by feel.

In a preferred embodiment, the means associated with the upper surface is a fiber fastening strip and typically is an enlarged fiber fastening area on the upper surface of the plate which allows a plurality of the foot pedal operated sound effect generators to be mounted thereon. The invention also provides a fiber fastening cooperative layer which is used for attachment to the underside of the sound effect generators. In this way, the fiber fastening attachment layers on the underside of the foot pedals are capable of being releasably attached to the fiber fastening strip on the upper surface of the plate. Typical fiber fastening members which may be used include those offered commercially under the name "Velcro".

In another preferred embodiment of the invention, a carrying case, such as a lid, is provided for detachable connection to the pedal board. In this way, a carriable case is formed and allows for the storage of the generators therein when carried or stored. One of the important aspects of the present invention is the fact that the pedal board is designed to releasably mount essentially any commercially available type of pedal and is not limited to any particular model or size. Moreover, when mounted thereon, the pedals can be retained on the pedal board after the carrying is attached so that the pedal boards can be carried in precisely the positions in which they were mounted.

In another embodiment of the invention, a wiring harness is associated with the board for allowing connection of the generator to the musical instrument and the amplifier directly through the board itself. In this respect, a housing is located beneath the upper surface of the plate and this housing is adapted to carry the wire harness therein. Moreover, plug-in jacks are located on the board and are connected to the wiring harness to allow connection of the generator to the instrument and an amplifier.

The pedal board of the present invention is also highly effective in that it provides a specific way to releasably hold a plurality of pedals and to allow those pedals to be transported in a carrying case arrangement from one location to another. Moreover, the pedals can be carried in precisely the arrangement as when mounted on the board so that a player can become accustomed to the precise location of the pedals on that pedal board without fear of having them moved during transport. In addition, the pedal board of the present invention provides a patch bay or patch arrangement for allowing each of the pedals to be connected to desired inputs and outputs for the sound. Further, the pedal board of the present invention also allows for delivery of electrical power directly to the foot pedals and through the patch bay in the pedal board. Consequently, the numerous wires which are frequently required in the prior art are now completely avoided. Thus, the power is provided in an integrated environment in the case.

This invention possesses many other advantages and has other purposes which may be made more clearly apparent from a consideration of the forms in which it may be embodied. These forms are shown in the drawings forming a part of and accompanying the present specification. They will now be described in detail for purposes of illustrating the general principles of the invention, but it is to be understood that such detailed description and the accompanying drawings are not to be taken in a limiting sense.

BRIEF DESCRIPTION OF THE DRAWINGS

Figure 1:
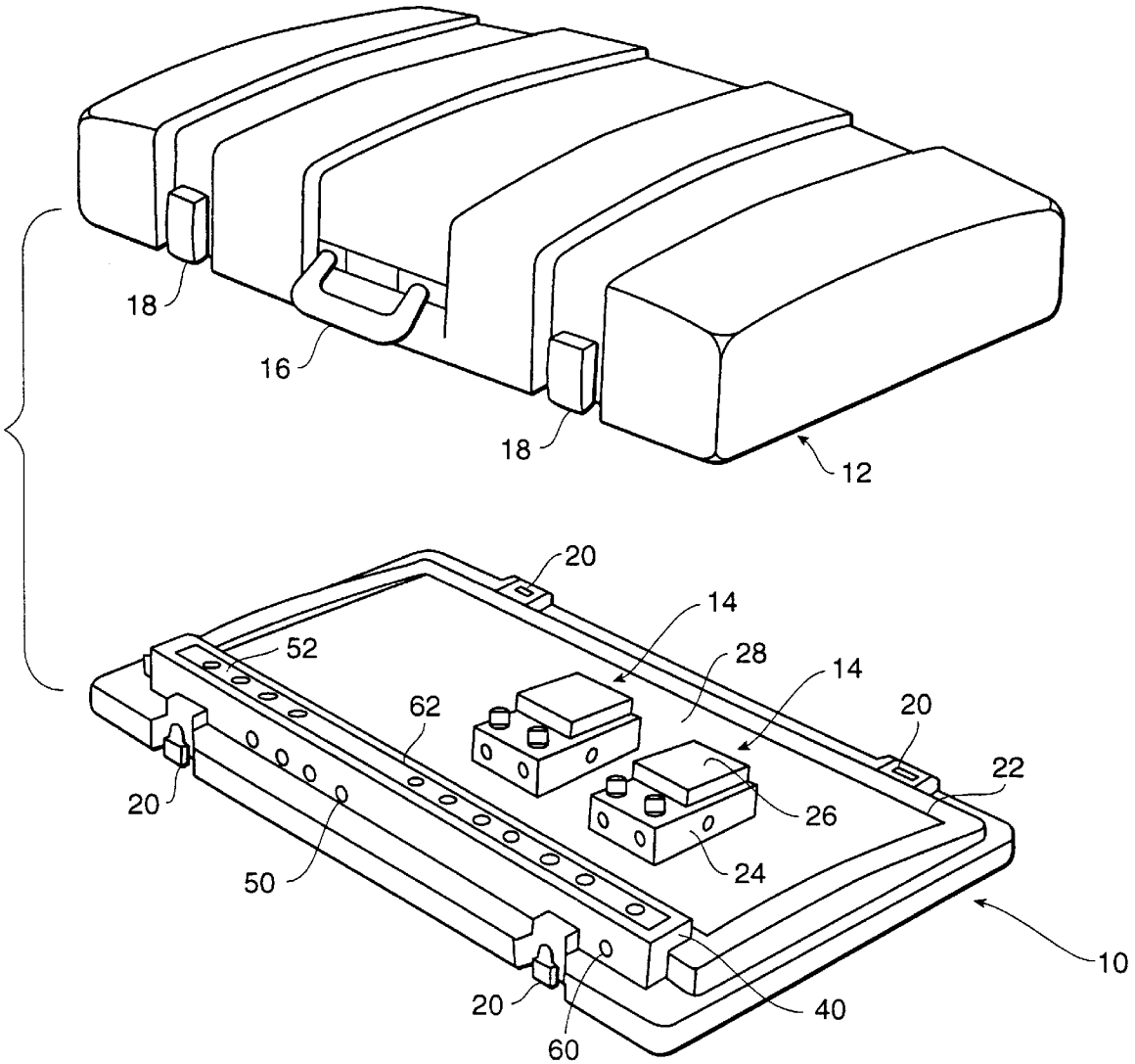
Figure 2:
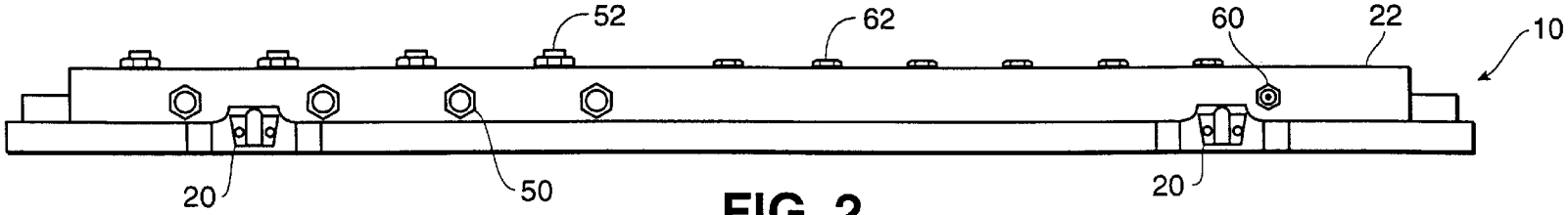
Figure 3:
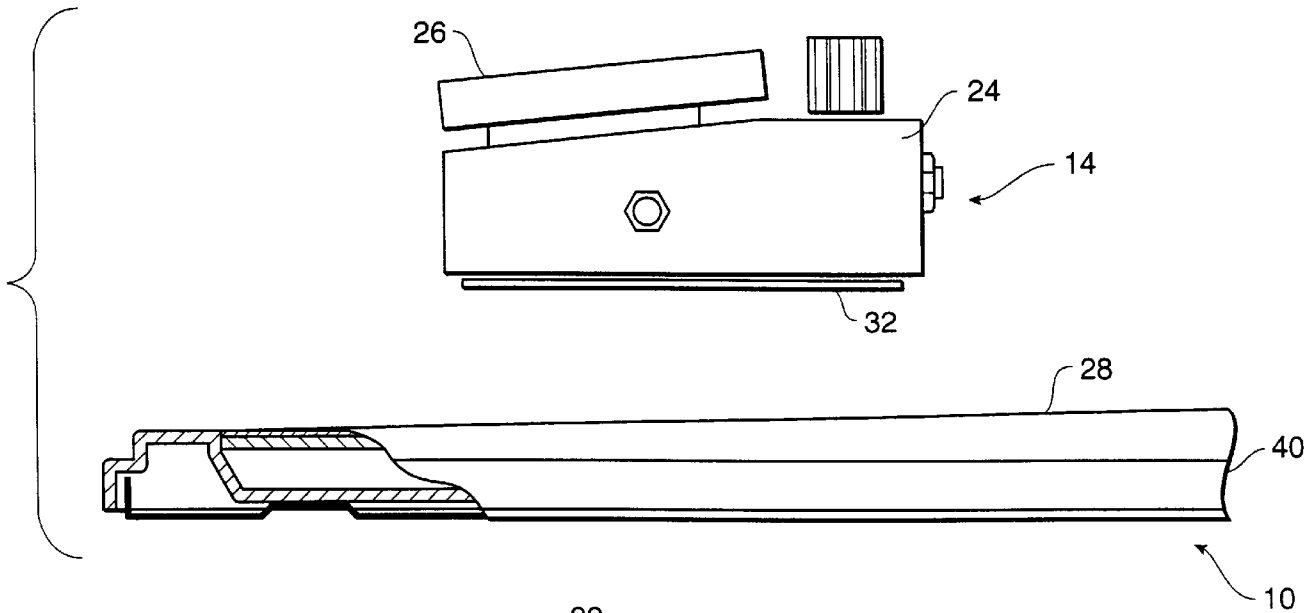
Figure 4:
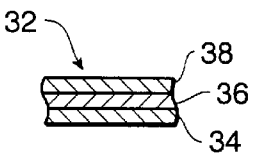
Figure 5:
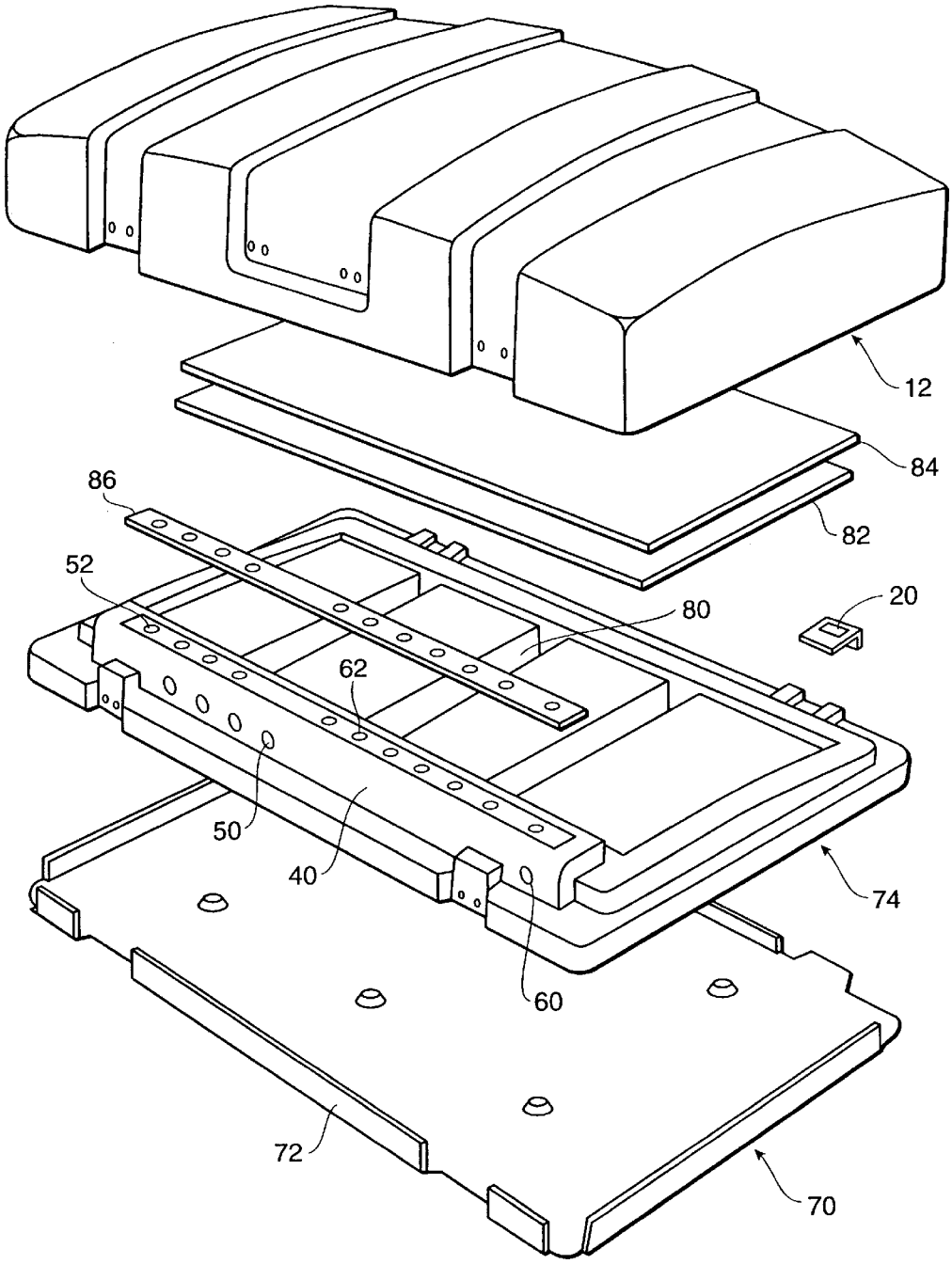
Figure 6:
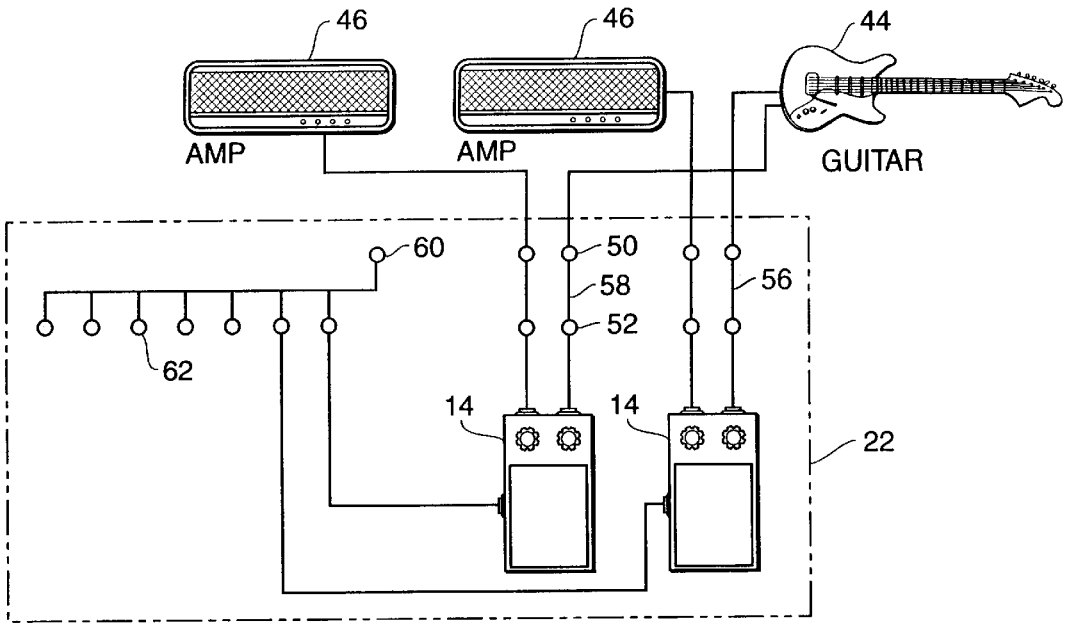
Figure 7:
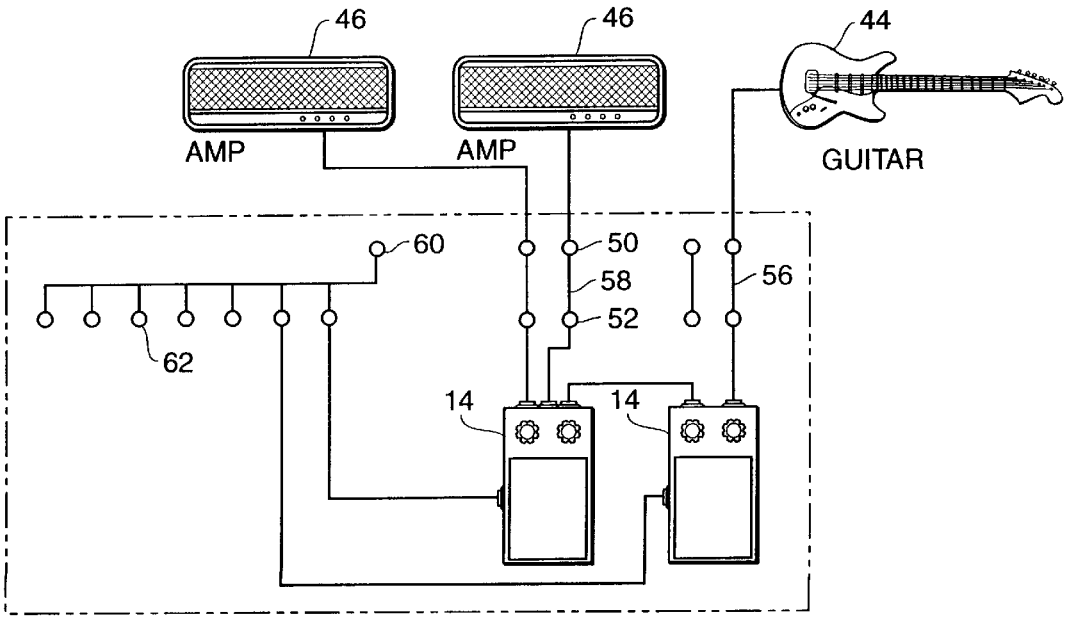
Figure 8:
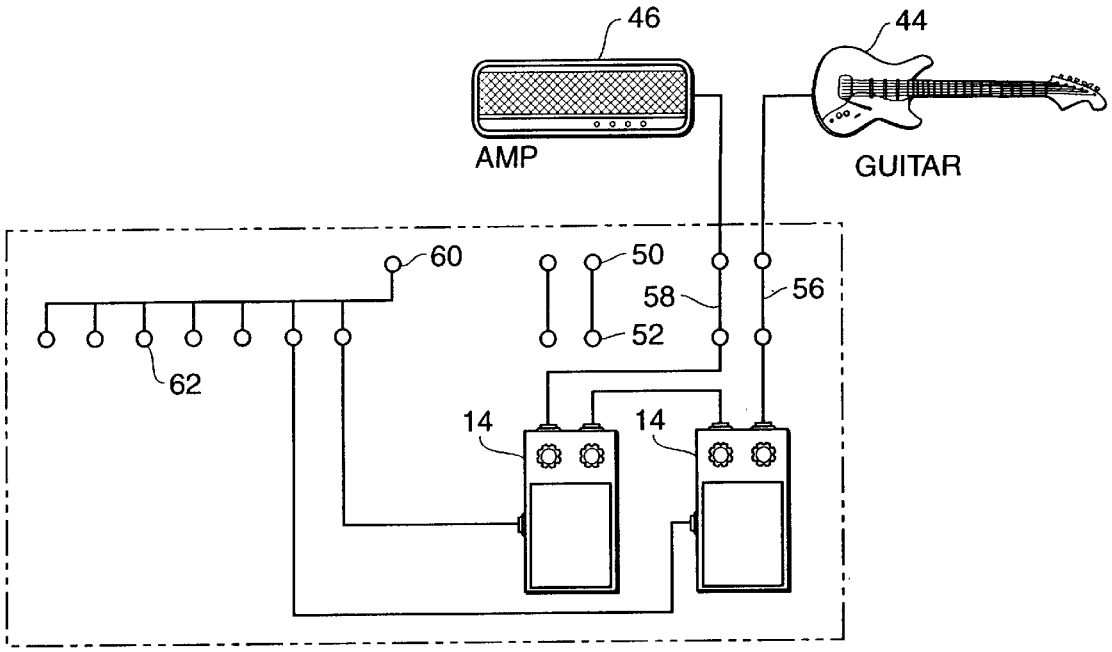
Figure 9:
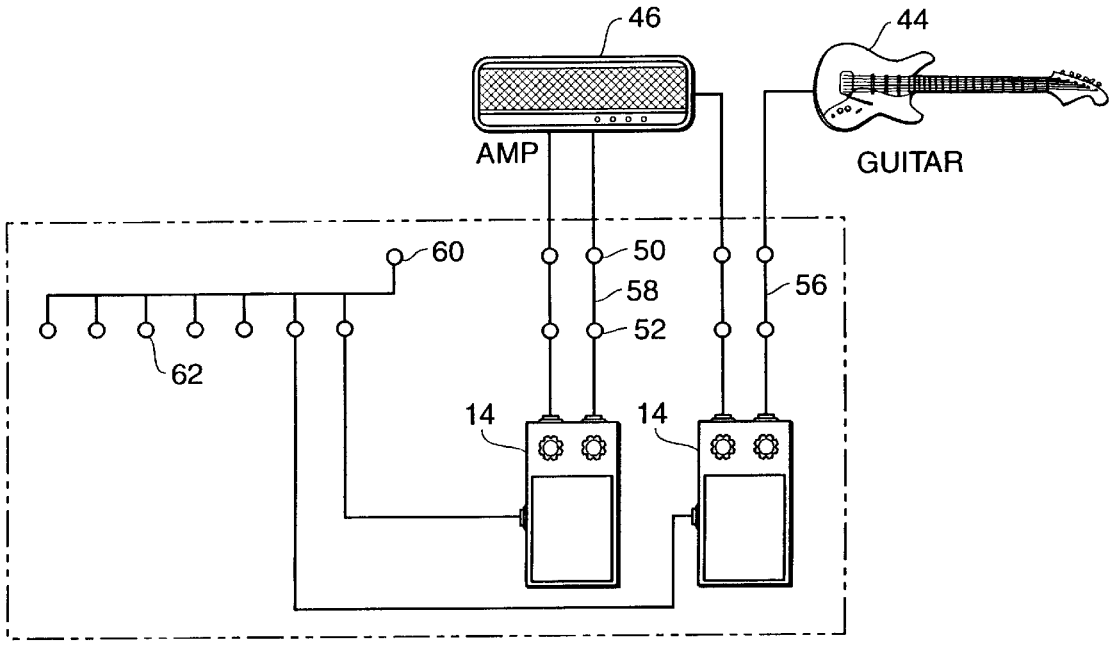

Having thus described the invention in general terms, reference will now be made to the accompanying drawings in which:

FIG. 1 is an exploded perspective view showing a pedal board of the present invention and a lid used therewith to form a carrying case in accordance with the present invention;

FIG. 2 is a front elevational view of the pedal board of FIG. 1;

FIG. 3 is a fragmentary exploded side elevational view showing the means for releasably attaching a foot pedal to the pedal board;

FIG. 4 is a fragmentary vertical sectional view showing the use of an attachment strip for location on the underside of foot pedals enabling attachment to the pedal board in accordance with the present invention;

FIG. 5 is an exploded perspective view showing the various components forming part of the pedal board of the present invention;

FIG. 6 is one form of a schematic circuit diagram showing the arrangement of the various components forming part of the pedal board and an operative connection to an amplifier and guitar;

FIG. 7 is a schematic circuit diagram similar to FIG. 6 and showing an alternate arrangement of connection of foot pedals to a guitar and an amplifier; and FIGS. 8 and 9 illustrate yet different connecting arrangements for a single amplifier and a guitar relative to the foot pedals.

DETAILED DESCRIPTION OF A PREFERRED EMBODIMENT

Referring now in more detail and by reference characters to the drawings which illustrate a preferred embodiment of the present invention, 10 designates a pedal board which is frequently used in conjunction with a carrying case 12 of the type illustrated in FIG. 1 of the drawings.

The carrying case 12 is adapted for releasable connection to the pedal board 10 so that the pedal board 10, in effect, serves as a bottom to a type of suitcase arrangement. In this way, a plurality of pedal operated sound effect generators 14 may be stored and carried in a compartment formed by the attached carrying case over the pedal board 10. Hinge elements 17 can connect the case 12 to the board 10.

The carrying case 12 may be suitably provided with one or more handles 16 and latches 18 which cooperate with suitable latch elements 20 on the pedal board, in the manner as shown in FIG. 1. It should also be observed that suitable releasably locking latch 18 and latch elements 20 are also located on the opposite side of the pedal board so that the carrying case 12 can be locked to both longitudinal sides of the pedal board 10.

The pedal board 10 is preferably formed of a relatively light weight yet durable plastic, such as a polypropylene or acetylbutylstyrene, or the like. However, the pedal board may be made of a suitable metal, if desired, or for that matter it may be made of wood or other structural material. The carrying case 12 could also be made of any of the aforesaid materials. Light weight plastics are preferred, although the releasable latches 18 and 20 are preferably formed of a light weight stainless steel.

The pedal board is provided with an a top plate 22 adapted to receive one or more of the pedal operated sound effect generators 14. These sound effect generators 14 are conventional in construction and are designed to provide various different types of sound effects to the music which is generated through the musical instrument. However, each of the foot pedal operated sound effect generators 14 include a base housing 24 and a foot pedal 26 which, when depressed, will enable generation of a sound effect. Typically, the sound effect generating mechanism is included within the housing 24 and actuated when the foot pedal 26 is depressed.

The top plate 22 is provided with a releasable attachment mechanism, such as a fiber fastening surface 28. In like manner, the underside of the housing 24 forming part of the sound effect generator 14 is provided with a cooperative fiber fastening attachment strip 32, as best shown in FIG. 3. In this way, when the foot pedal 14 is placed upon the fiber fastening surface 28, it will immediately and physically adhere to the fiber fastening attachment surface 28. The fiber fastening attachment surface 28, as well as the attachment strip 32, will be cooperative with one another such that one will have a loop-type arrangement and the other will have a hook-type arrangement so that the two can be releasably hooked to one another. One suitable type of fiber fastening attachment surface which may be used in accordance with the present invention is that type commercially offered under the name and mark "Velcro".

The foot pedal operated sound effect generators 14 typically are not provided with an attachment surface on their underside when commercially sold. For this purpose, the present invention provides a plurality of cooperating attachment strips 32 which are more fully illustrated in FIG. 4 of the drawing. These cooperating attachment strips 32 comprise a layer 34 of the fiber fastening loops or hooks forming part of the fiber fastening attachment mechanism. This layer 34 having the fiber fastening loops or hooks is provided on its upper surface with an adhesive layer 36 and which is, in turn, releasably covered with a release backing 38, all as best shown in FIG. 4 of the drawings. In this way, when the user of the pedal board desires to mount a pedal onto the pedal board, the user will remove the releasable backing strip 38 and cause an adhesive attachment of the cooperative attachment strip 32 to the underside of the foot pedal 14. This will enable the fiber fastening portion of that strip to releasably adhere to the fiber fastening attachment strip 28 on the upper surface of the pedal board.

The pedal board of the present invention is highly effective in that enables the use of a large number of pedals each offering different types of sound effects to be used on the pedal board. Moreover, since the foot pedal operated sound effect generators or so-called "foot pedals" are located in a specific position on the board, they are immediately available and accessible for the musician to operate without having to look for these pedals. They, in effect, remain in precisely the same position in which they were mounted on the board. Moreover, they are not movable without physically engaging the foot pedal and pulling the same from the upper surface of the board.

Also mounted on the pedal board 10 is an electrical patch housing 40 having an interior compartment designed to hold a wiring harness 42 of the type more fully illustrated in FIGS. 6–9 of the drawings. This wiring harness allows for connection of the various foot pedal operated sound effect generators 14 to a guitar, schematically shown by reference numeral 44 in FIG. 6, and to an auxiliary sound generating component which, in this case, is shown to be an amplifier 46, also schematically shown in FIGS. 6 and 7 of the drawings.

The auxiliary sound generating component may frequently adopt the form of an amplifier. However, this auxiliary sound generating component may adopt the form of another effect processing unit, a tape recorder or the like. Guitars and other musical instruments are frequently connected to these other forms of auxiliary sound generating components in order to either record, broadcast, or otherwise vary the effects of the musical output. Thus, the pedal board will have an outlet jack (hereinafter described) for connection, as may be desired, to any one or more of these additional auxiliary sound generating components.

It should also be understood that a printed circuit board or other form of electrical circuit arrangement could be located within the electrical patch housing 40. In this way, the typical wiring arrangement of numerous cables connecting various foot pedals to an amplifier and a musical instrument can be completely avoided. Moreover, the attendant problems of the musician having his or her feet caught up in the cables is similarly avoided.

The housing 40 is also provided on its exterior surface with a plurality of cooperating pairs of sound effect generating patch jacks 50 and a plurality of sound effect patch jacks 52. In this way, the musical instrument 44 and the amplifier 46 or other auxiliary sound generating component may be connected directly to the pedal board by cables 56 and 58, respectively, in the manner as shown in FIGS. 6 and 7 of the drawings.

The inlet jacks 50 are designed to receive an input directly from the musical instrument, such as the guitar 44. The jacks 52 would be connected by means of patching cords to the auxiliary sound generating components 46, such as the amplifier, as shown.

The housing 40 is also provided with a DC power inlet 60 and a plurality of DC power outlet jacks 62. The DC power inlet jack 60 may be connected directly to a power supply which is, in turn, provided with a source of electrical current in order to enable each of the jacks 62 to provide a desired DC power source, as for example, a nine volt DC source of power. Although the power supply may be independently mounted directly to a wall socket, it should be understood that the power supply could be directly incorporated within the housing 40 and connected to the inlet jack 60 so that when a source of power is received, a desired nine volt regulated power can be delivered to each of the outlet jacks 62.

One preferred form of a pedal board construction is more fully illustrated in the exploded perspective view of FIG. 5 of the drawings. In this case, it can be seen that one preferred pedal board construction utilizes a sheet metal frame 70 having upturned side wall forming peripheral retaining flanges 72. Disposed on the sheet metal frame 70 is a plastic base 74 which generally carries the upstanding electrical patch housing 40. Integrally formed with the plastic base 74 is a reinforcing structure comprised of a plurality (four as shown) of transversely extending frame ribs 80.

Disposed on and supported by the frame ribs 80 is a relatively rigid wooden board 82 and which is preferably formed of a masonite other form of fiberboard type material. Finally, disposed on the upper surface of the masonite or other fiberboard 82 is a layer of carpet 84. This carpet serves as the loop section of the fiber reinforcing layers and cooperates with a Velcro layer on the underside of the pedals 14.

In addition, and latched on the upper surface of the electrical patch housing 40, is a printed label 86 and which may be secured to the patch housing 40 by any suitable means. The various other components are also secured together by suitable means as known in the art.

A pair of the foot pedal operated sound effect generators 14 are mounted on the support surface 22 of the pedal board, as shown in FIG. 6. These two foot pedals 14 are connected directly to the inlets and outlets, as shown in FIG. 6. In this way, it can be seen that one of the foot pedals is electrically connected in series between the guitar and the amplifier and the other foot pedal 14 is also connected in a series relationship with respect to the amplifier 46 and the guitar 44.

In FIG. 7, it can be seen that a similar wiring arrangement is employed, although patch cables are used to connect each of the individual foot pedal sound effect generators 14 to one another and in a series arrangement with respect to the guitar 44 and the amplifier 46. In this case, one of the foot pedals receives an input directly from the guitar 44 and the second of the foot pedals receives an input from the first of the foot pedals only the second foot pedal has outputs to one or more amplifiers, as shown in FIG. 7. This type of arrangement will provide a somewhat different sound than that provided in the arrangement of FIG. 6.

FIGS. 8 and 9 illustrate still other arrangements of connecting a musical instrument, such as a guitar 44, to one or more auxiliary sound generating components, such as the amplifiers 46, as shown. Again, it can be seen that patch cords would be used for connection to the various jacks 50 and 52. In like manner, all of FIGS. 6–9 show the connecting of the various foot pedal sound effect generators 14 to the DC power outlet jacks 62 so that they may be operated by a proper current and voltage level.

The circuit arrangements illustrated in FIGS. 6–9 are only exemplary and designed to show the numerous possibilities of connecting the various foot pedals to the musical instrument and to the amplifier. Moreover, all of these connections can be made without a maze of conductors extending between the amplifier and the foot pedal and the musical instrument.

Thus, there has been illustrated and described a unique and novel sound board which enables the releasable mounting and fixed location of a plurality of foot pedals thereon and which also enables the connecting of the foot pedals with respect to an auxiliary sound generating component and a musical instrument in a desired arrangement. The present invention thereby fulfills all of the objects and advantages which have been sought. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention.

Having thus described the invention, what I desire to claim and secure by Letters Patent is:

1. A pedal board for releasably retaining a plurality of foot pedal operated sound effect generators used in conjunction with a musical instrument, said pedal board comprising:

a) a plate having a relatively flat upper surface;

b) means associated with said plate forming a housing with said plate;

c) a wiring harness located within said housing allowing for connection of sound effect generators on the board to the musical instrument and an electrically operable accessory therefore directly through the wiring harness for delivery of sound effect signals to the musical instrument or the electrically operable accessory therefor and which sound effect signals will modify the sound otherwise generated from the musical instrument;

d) plug means on a surface of the board which is connected to the wiring harness and which plug means includes first electrical conductors to enable releasable connection of the sound effect generators to the instrument and electrically operable accessory for delivery of the sound effect signals from the accessory to the musical instrument;

e) second electrical conductors connected to said wiring harness for delivery of electric power to said sound effect generators to thereby power same; and f) means on an upper surface of said plate for releasably retaining the generators.

2. The pedal board of claim 1 further characterized in that the means on the upper surface of the plate comprises a surface to releasably and fixedly hold the generators in fixed positions on the upper surface of the board.

3. The pedal board of claim 2 further characterized in that said means associated with the upper surface is a fiber fastening strip and a fiber fastening cooperation layer is provided for attachment to an underside of said sound effect generators.

4. The pedal board of claim 2 further characterized in that a carrying case is provided for detachable connection to the pedal board to form a carriable case when connected and allows for storage of the generators therein.

5. A pedal board for releasably retaining a plurality of foot pedal operated sound effect generators used in conjunction with a musical instrument, said pedal board comprising:

a) a plate having a relatively flat upper surface;

b) means associated with said plate forming a housing with said plate;

c) a circuit located within said housing allowing for connection of sound effect generators on the board directly to the musical instrument and an amplifier therefore directly through first conductors in the circuit for delivery of sound effect signals to the musical instrument or an amplifier therefor;

d) means for receiving a source of electrical power into said pedal board; and e) means on said board for delivering electrical power suitable for operation of the foot pedal generators directly to said generators through second conductors to enable said generators to be electrically operated.

6. The pedal board of claim 5 further characterized in that a plug means is on a surface of the board which is connected to the circuit to enable releasable connection to the instrument and an auxiliary sound generating component for delivery of the sound effect signals.

7. The pedal board of claim 6 further characterized in that additional plug means is provided in said board for connection of electrical power from the board to the generators.

8. The pedal board of claim 6 further characterized in that said plug means forms part of a patch bay having a plurality of individual plugs to be connected to the sound effect generators.

9. The pedal board of claim 8 further characterized in that said pedal board is generally orthogonal in shape and having a rearward edge in proximity to a musician using the pedal board and a forward edge distal to the musician, and said patch bay is located at said forward edge so that any electrical conductors from the sound effect generators are connected directly at the patch bay and away from the feet of the musician.

10. The pedal board of claim 8 further characterized in that these additional individual plugs are provided on said board for connection of electrical power from an electrical power source to said sound effect generators.

11. The pedal board of claim 5 further characterized in that means is on an upper surface of said plate for releasably retaining the generators.

12. The pedal board of claim 8 further characterized in that said board is generally orthogonal in shape and having a rearward edge in proximity to a musician using the pedal board and a forward edge distal to the musician, and said patch bay is located at said forward edge so that any electrical conductors from the sound effect generators are connected directly at the patch bay and away from the feet of the musician.

13. A pedal board for releasably retaining a plurality of foot pedal operated sound effect generators used in conjunction with a musical instrument, said pedal board comprising:

a) a relatively flat plate having a relatively flat upper surface;

b) means associated with said plate forming a housing with said plate;

c) a foot pedal on each sound effect generator such that actuation of the foot pedal by the foot of a musician will actuate the associated sound effect generator and where any foot pedals on said plate are not readily observable during use of same;

d) means associated with the upper surface of said plate and releasably cooperating with a holding means on an undersurface of each of the foot pedal sound effect generators to releasably hold a plurality of such foot pedal sound effect generators of varying size and shape on the upper surface of the board so that the generators may be fixedly although removably mounted on said upper surface in fixed locations desired and preselected by each musician who may use the pedal board according to that musician's own preference, to thereby enable a musician to easily and immediately locate each of the generators by feel and to allow a musician to become accustomed to a precise location of the generators by learning the sensed location of the generator from use, and where the pedal board may be transported with each of the generators remaining in their fixed positions so that the musician may again use the generators in the same learned positions on a subsequent occasion;

e) a wiring harness located within said housing allowing for connection of sound effect generators on the board to be connected to the musical instrument and an electrically operable accessory therefore directly through the wiring harness for delivery of sound effect signals to the musical instrument or the electrically operable accessory therefor and which sound effect signals will modify the sound otherwise generated from the musical instrument;

f) a patch bay on said upper surface;

g) first plug means on said patch bay and which is connected to the wiring harness and which first plug means includes a first electrical conductor to enable releasable connection of the sound effect generators to the instrument and the electrically operable accessory for delivery of the sound effect signals from a generator to the musical instrument; and h) second plug means on said patch bay including second electrical conductors to enable a source of electrical power to be connected to said generators to power same for electrical operation thereof.

14. The pedal board of claim 13 further characterized in that said means associated with the upper surface of said plate is a fiber fastening strip and the holding means on the undersurface of the pedal board is a fiber fastening cooperation layer provided for attachment to an underside of said sound effect generators.

* * * * *